United States Patent [19]

Sakai

[11] Patent Number: 4,798,926

[45] Date of Patent: Jan. 17, 1989

[54] METHOD OF HEATING SEMICONDUCTOR AND SUSCEPTOR USED THEREFOR

[75] Inventor: Takamasa Sakai, Kusatsu, Japan

[73] Assignee: Dainippon Screen Mfg. Co., Ltd., Kyoto, Japan

[21] Appl. No.: 22,885

[22] Filed: Mar. 6, 1987

[30] Foreign Application Priority Data

Mar. 6, 1986 [JP] Japan ..... 61-047282

[51] Int. Cl.[4] ..... H05B 6/10

[52] U.S. Cl. ..... 219/10.43; 219/10.491; 219/10.67; 219/10.79; 118/50.1; 118/728

[58] Field of Search ..... 219/10.49 R, 10.43, 219/10.67, 10.75, 10.79; 148/1.5; 118/728, 50.1

[56] References Cited

U.S. PATENT DOCUMENTS

| | | | |
|---|---|---|---|
| 2,830,162 | 4/1958 | Copson et al. | 219/10.55 E |
| 3,238,024 | 3/1966 | Cremer et al. | 219/10.49 R X |
| 3,521,018 | 7/1970 | Boerger et al. | 219/10.49 R |
| 3,665,139 | 5/1972 | Steggewentz | 219/10.43 |
| 3,684,853 | 8/1972 | Welch et al. | 219/10.67 X |
| 3,754,109 | 8/1973 | Moulin et al. | 219/10.61 X |
| 3,979,572 | 9/1976 | Ito et al. | 219/10.49 R |
| 4,499,354 | 2/1985 | Hill et al. | 219/10.49 R |
| 4,633,051 | 12/1986 | Olson | 219/10.49 R |

*Primary Examiner*—Philip H. Leung

*Attorney, Agent, or Firm*—Lowe, Price, Leblanc, Becker & Shur

[57] ABSTRACT

Disclosed is a method of heating a semiconductor in a heat treatment apparatus for heating the semiconductor at a high temperature, in which a semiconductor is put in the heat treatment apparatus, and an alternating magnetic field is applied to a low-resistance ferromagnetic substance disposed in the heat treatment apparatus and isolated by a material inert to a required treatment atmosphere in the heat treatment apparatus to generate heat in the low-resistance ferromagnetic substance to thereby carry out heat treatment on the semiconductor. Further disclosed is a susceptor for supporting a semiconductor inertly to a required treatment atmosphere in a heat treatment apparatus, the susceptor being constituted by a material which is inert to the treatment atmosphere in the treatment apparatus and a low-resistance ferromagnetic substance isolated by the inert material from the treatment atmosphere. Preferably, a Curie point of the low-resistance ferromagnetic substance is set in accordance with a temperature at which the semiconductor is heated.

6 Claims, 3 Drawing Sheets

METHOD OF HEATING SEMICONDUCTOR AND SUSCEPTOR USED THEREFOR

BACKGROUND OF THE INVENTION

1. Field of the Invention

The present invention generally relates to heat treatment of a semiconductor in semiconductor processing. The present invention particularly relates to a method of performing heat treatment of a semiconductor and to a susceptor used in the method.

2. Description of the Prior Art

Conventionally, infrared radiation heating and high-frequency induction heating have been the main current in the method of heating a semiconductor wafer in semiconductor processing, for example, epitaxial growth processing, or the like.

The infrared radiation heating is a typical one of the so-called hot wall heating methods in which not only a semiconductor wafer but a reaction vessel or the like is simultaneously heated. The hot wall heating method has a defect that it requires a reflector for preventing heat radiation out of the reaction vessel, means for cooling the reflector, and so on.

The high-frequency induction heating is carried out in such a manner than a susceptor which is supporting a semiconductor wafer thereon is heated by an induction current owing to high-frequency energy so that the semiconductor wafer is heated by the heat applied from the heated susceptor through transmission and radiation. The high-frequency induction heating is a typical one of the so-called cold wall type heating methods in which a reaction vessel and so on are not heated.

FIG. 7 shows an example of a horizontal epitaxial growth apparatus employing the conventional high-frequency induction heating method.

A susceptor C for supporting a semiconductor wafer B to be treated is disposed in a quartz pipe A for isolating a treatment atmosphere in the quartz pipe A from the external atmosphere, and a coil D is wound around the outside of the quartz pipe A coaxially with the later.

The susceptor C is constituted by a conductive material of carbon with its surface coated with silicon carbide. The susceptor C is heated by an induction current owing to a high-frequency magnetic field generated by the coil D, and the generated heat is applied to the semiconductor wafer B through transmission and radiation to thereby heat the semiconductor wafer B.

In the semiconductor heating apparatus used in semiconductor processing, it is required to generate a high temperature of 500° through 1200° C. and to isothermally keep the high temperature for hours, and therefore a very large amount of electric power is consumed.

In this regard, the cold wall heating can be easily carried out by means of the above-mentioned high-frequency induction heating, however, the high-frequency heating is disadvantageous in that the energy conversion efficiency is very low such that only about 10% of the consumed electric power is converted into heat required for heating.

In the high-frequency induction heating method, as well known, the heat energy generated in the susceptor C can be expressed as a function having main elements such as the magnetic field strength applied to the susceptor C, the frequency of change in direction of the applied magnetic field, the resistivity of the susceptor C, the permeability of the magnetic path of the coil D, and so on. In order to increase the generated heat energy, there are a method in which the resistivity of the susceptor is made smaller or the permeability of the magnetic path is made higher to thereby make higher the efficiency of conversion from the consumed electric power to the generated energy, and a method in which the strength of the magnetic field is made larger or the frequency of the alternating magnetic field is made higher to thereby make higher the efficiency of conversion from the consumed electric power to the generated energy.

Of those elements making the conversion efficiency higher, any materials available for the conductive susceptor C, except conventionally used carbon or the like, cannot be expected to provide remarkably low resistance and therefore it is impossible to make low the resistivity of the susceptor C.

The permeability of the magnetic path of the coil D, on the other hand, is limited to the permeability of a vacuum because the coil D is provided with an air core. In the existing circumstances, accordingly, there is not any other measure than making the magnetic field strength larger and the frequency of the alternating magnetic field higher to increase the generation of thermal energy by varying those elements in the conventional high-frequency induction heating system.

In the conventional high-frequency induction heating system, however, the electric power is supplied from an ordinary commercial AC power source E to the coil D through conversion means, such as a frequency converter F, an impedance matching circuitry G, etc., so that the magnetic field strength applied to the susceptor C is determined substantially in accordance with the current caused to flow in the coil D.

However, this current is so large that the loss due to the resistance of the coil D becomes large and therefore the coil per se must be cooled by water or the like, resulting in a limit in increase in the magnetic field strength.

Further, there are limits in frequency characteristics, control power, etc., of switching elements or the like used in the large power frequency converter F, and therefore it is impossible to expect much increase both in the frequency and in the control power.

In the impedance matching circuitry G, the coil current is so large that the copper loss becomes large and therefore the conversion efficiency is low.

Recently, the size of semiconductor wafers has been changed from the conventional values of 7.6 through 12.7 cm (3 through 5 inches) to 15.2 through 20.3 cm (6 through 8 inches). Also in this regard, heat treatment furnaces are desired to be improved in increase of the generated heat energy.

SUMMARY OF THE INVENTION

It is therefore an object of the present invention to solve the above problems in the prior art.

It is another object of the present invention to provide a method of performing heat treatment of a semiconductor with an improved thermal energy conversion efficiency.

It is a further object of the present invention to provide a method of performing heat treatment of a semiconductor, in which isothermal control can be performed.

It is a still further object of the present invention to provide a susceptor to be used in the improved method of performing heat treatment of a semiconductor.

In order to attain the above objects, according to an aspect of the invention, the method of heating a semiconductor in a heat treatment apparatus for heating the semiconductor at a high temperature is featured by comprising the steps of: putting a semiconductor in the heat treatment apparatus; and exerting an alternating magnetic field onto a low-resistance ferrogmagnetic substance isolated by a material which is inert to a required treatment atmosphere in the heat treatment apparatus to generate heat in the low-resistance ferrogmagnetic substance to thereby carry out heat treatment on the semiconductor.

According to another aspect of the present invention, the susceptor for supporting a semiconductor inertly to a required treatment atmosphere in a heat treatment apparatus, is featured in that the susceptor is constituted by a low-resistance ferromagnetic substance which is isolated from a treatment atmosphere in the treatment apparatus by a material which is inert to the treatment atmosphere.

Preferably, in the susceptor, a Curie point of the low-resistance ferrogmagnetic substance is set in accordance with a temperature at which the semiconductor is heated.

An alternating magnetic field is applied to the ferromagnetic substance having lower electric resistance and higher permeability in comparison with carbon which has been used for the conventional susceptor. Accordingly, even if the amount and the frequency of the current caused to flow in the coil are the same as those in the conventional method, the amount of the alternating magnetic flux passing through the low-resistance ferromagnetic substance is increased and hence the quantity of the generated heat in the magnetic substance is increased, so that the energy conversion efficiency can be made high.

Further, being isolated from the treatment atmosphere by a material inert to the treatment atmosphere, the ferromagnetic substance never has a bad influence on the semiconductor.

BRIEF DESCRIPTION OF THE DRAWINGS

Other objects and advantages of the invention will be apparent from the ensuing specification and drawings showing embodiments of the invention, in which.

DETAILED DESCRIPTION OF PREFERRED EMBODIMENTS

Figure 1:
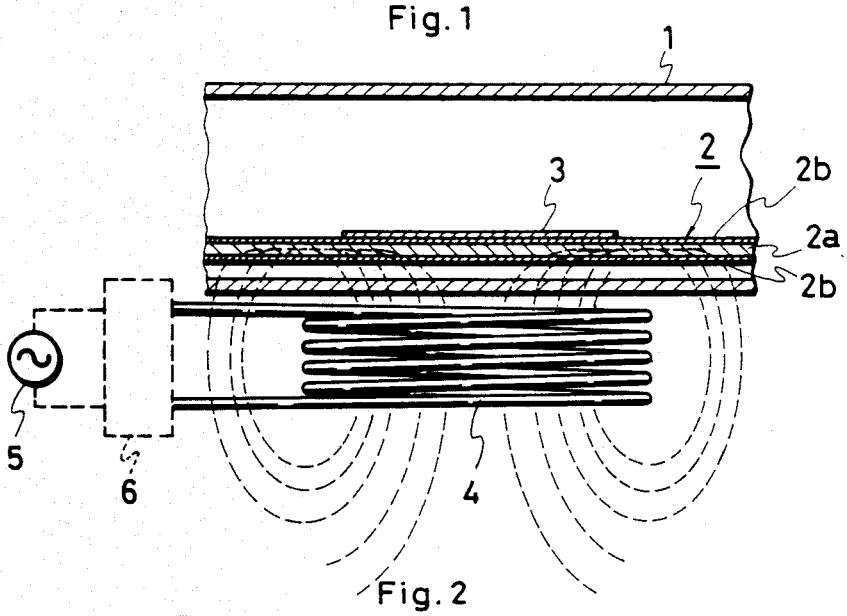
FIG. 1 is a diagramatical side view partly in section for explaining a first embodiment of the method according to the present invention.

Now, referring to the drawings, preferred embodiments of the invention will be described hereunder.

FIG. 1 is a diagram for explaining a first embodiment of the method according to the present invention. In FIG. 1, a susceptor 2 is disposed in a quartz pipe 1 for isolating a treatment atmosphere within the pipe from the external atmosphere, and a semiconductor wafer 3 to be heat-treated is mounted on the susceptor 2. The susceptor 2 is constituted by a flat plate-like low-resistance ferromagnetic substance **2*a* with its opposite main surfaces coated with a material 2*b* which is inert with respect the treatment atmosphere. A coil 4 for generating magnetic flux is connected to a high-frequency power source 5 for supplying the coil 4 with power through a matching circuit 6, and is arranged outside the pipe 1 in a manner so that the surface of winding of the coil 4 is in parallel to the surface of the plane surface of the susceptor 2**.

According to the first embodiment, the low-resistance ferromagnetic substance **2*a* of the susceptor 2 is disposed in a magnetic path of the coil 4, so that magnetic flux generated in the coil 4 highly efficiently passes through the susceptor 2 to generate eddy currents in the low-resistant ferromagnetic substance 2*a* of the susceptor 2 to thereby heat the susceptor 2. Thus, the semiconductor wafer 3 on the susceptor 3** is heat-treated.

Figure 2:
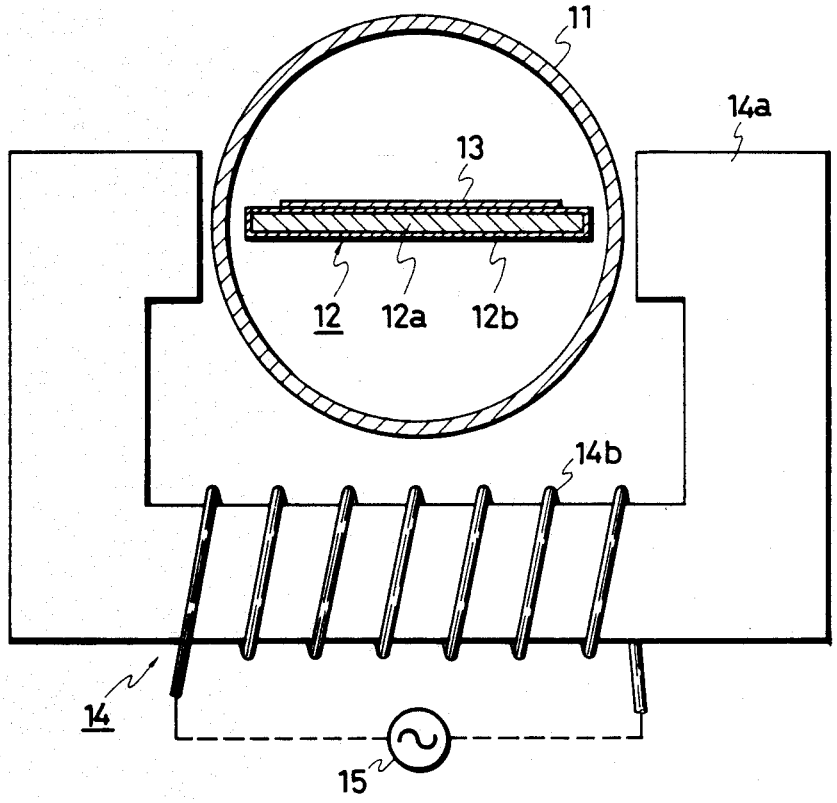
FIG. 2 is a diagramatical front view in section of a lateral type epitaxial growth apparatus for explaining a second embodiment of the method according to the present invention.

FIG. 2 is a diagram for explaining a second embodiment of the method according to the present invention. In the second embodiment of FIG. 2, similarly to the first embodiment, a susceptor 12 is disposed in a quartz pipe 11 for isolating a treatment atmosphere within the pipe from the external atmosphere, and a semiconductor wafer 13 to be heat-treated is mounted on the susceptor 12. The susceptor 12 is constituted by a flat plate-like low-resistance ferromagnetic substance **12*a* with its opposite main surfaces coated with a material 12*b* which is inert with respect the treatment atmosphere. In the second embodiment, however, unlike the first embodiment, a coil arrangement 14 constituted by a coil 14*b* wound on a yoke 14a of a high-resistance magnetic material is used for generation of magnetic flux. The coil 14*b* is connected to a high-frequency power source 15 for supplying the coil 14*b* with power through a matching circuit (not shown). The yoke 14*a* is arranged in a manner so that the magnetic path at the air gap portoin of the yoke 14*a* is shorted through the low-resistance ferrogmagnetic substance 12*a* of the susceptor 12**.

The magnetic field strength exerted onto the susceptor 12 is increased corresponding to the effective permeability of the magnetic path formed by the yoke **14*a* and the low-resistance ferrogmagnetic substance 12*a*, and the most part of the magnetic flux passing through the yoke 14*a* passes through the low-resistance ferromagnetic substance 12*a*** to contribute the heat generation.

Although the magnetic flux passes through the yoke **14*a* by substantially the same quantity as that passes through the low-resistance ferromagnetic substance 12*a*, the yoke 14*a* is made of a high-resistance ferromagnetic substance such as ferrite so that eddy currents generated in the yoke 14a** are very little and hence the heat due to the eddy currents is not so large as to produce a large loss.

In the above-mentioned first and second embodiments, the reactance of the coil is increased, so that impedance matching with a frequency converter or a frequency oscillator is facilitated, and particularly in the second embodiment, the coil arrangement 14 per se may be arranged as a frequency oscillator such as an invertor or the like.

Further, owing to the increase in impedance of the coil arrangement 14, the current dependency of the power supply becomes less so that it is possible to reduce the copper loss due to a DC resistance component of the coil to thereby make the conversion efficiency high.

Figure 3:
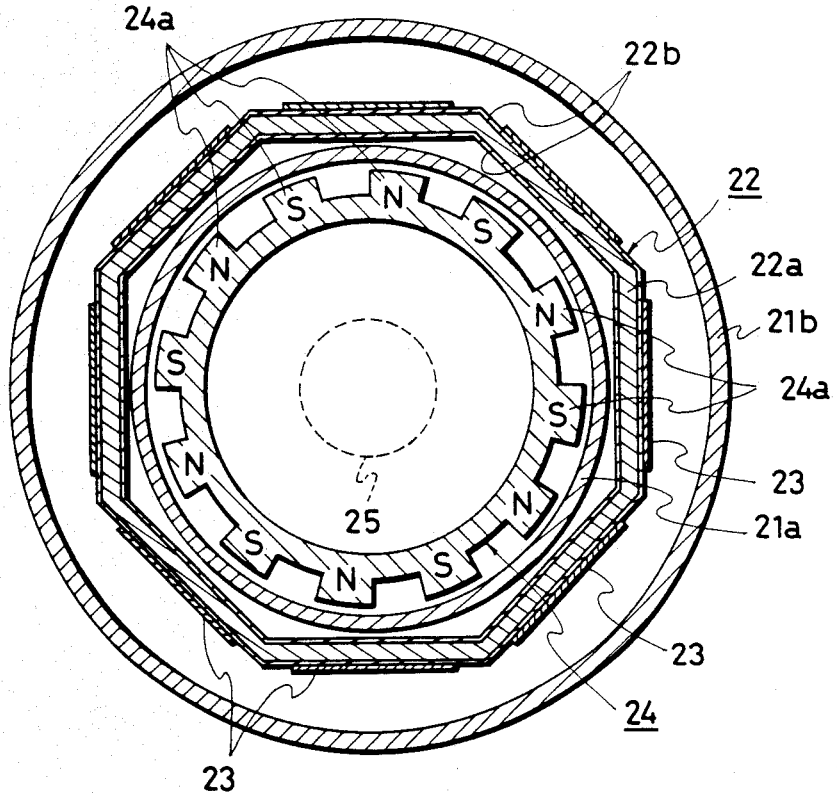
FIG. 3 is a diagramatical plan view in section of a barrel type epitaxial growth apparatus for explaining a third embodiment of the method according to the present invention.

FIG. 3 is a diagram for explaining a third embodiment of the method according to the present invention. In the third embodiment of FIG. 3, a so-called cylinder type or barrel type reactor is employed.

In the third embodiment, the quartz pipe arrangement is composed of an inner quartz pipe 21*a* and an outer quartz pipe 21*b*, a barrel type regular octagonal susceptor 22 is disposed in the space between the inner quartz pipe 21*a* and the outer quartz pipe 21*b*, and semiconductor wafers 23 to be heat treated are mounted on the susceptor 22. The susceptor 22 is constituted by a barrel structure 22*a* of a low-resistance ferromagnetic substance with its opposite main surfaces coated with a material 22*b* which is inert with respect the treatment atmosphere. A rotor 24 for generating a shifting magnetic field is disposed inside the inner quartz pipe 21*a*. The rotor 24 has a rotary shaft 25 which is connected to an electric motor (not shown) so that the rotor 24 is rotated by the motor. The rotor 24 has number of permanent magnets 24*a* arranged on its circumference in such a manner that S and N poles of the magnets 24*a* are circumferentially alternately disposed. The rotor 24 is arranged so as to be close to the inner surface of the susceptor 22 with the wall of the inner quartz pipe 21*a* interposed between the rotor 24 and the susceptor 22 so that the permanent magnets 24*a* rotate circumferentially along the inner surface of the inner quartz pipe 21*a*.

When the rotor 24 is driven to rotate, a shifting magnetic field having alternately changing S and N poles is applied to the low-resistance ferromagnetic substance 22*a* of the susceptor 22, so that eddy currents are generated in the low-resistance ferromagnetic substance 22*a* owing to the magnetic flux to thereby generate heat in the ferromagnetic substance 22*a*.

The motor energized by an AC source (not shown) causes rotational movement of the rotor 24 with a very high efficiency, and the rotational movement of the rotor 24 causes the permanent magnets to move circumferentially to thereby exert an alternating magnetic field onto the susceptor 22 while hardly generating electrical and mechanical losses. Thus, it is possible to perform the energy conversion with a high efficiency which could not been obtained in the conventional method.

Further, in the third embodiment, even in the case where a nonmagnetic conductive material such as carbon or the like is substituted for the low-resistance ferromagnetic substance 22*a* of the susceptor 22, heat is generated similarly to the foregoing case.

The embodiments have been described above as to various means for generating alternating magnetic field exerted onto the susceptor 2, 12, and 22. Next, description will be made as to various embodiments of the structure of the susceptor per se for use in the method according to the present invention.

Figure 4:
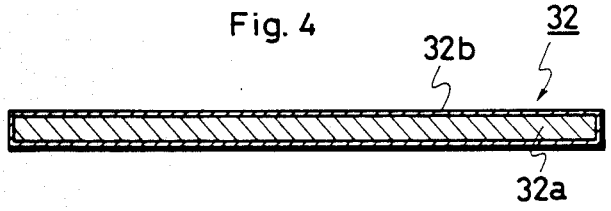
FIGS. 4 through 6 are sectional views showing various embodiments of the susceptor according to the present invention.

FIG. 4 shows a susceptor 32 which is formed in such a manner that the central portion is made of a low-resistance ferromagnetic substance 32*a* such a iron, nickel, cobalt, or an ally of them and the entire surface of the low-resistance ferromagnetic substance 32*a* is plated with a metal such as nickel 32*b* or the like which is inert to a required chemical treatment atmosphere.

Figure 5:
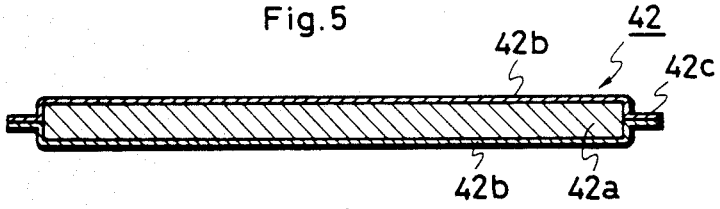
Figure 6:
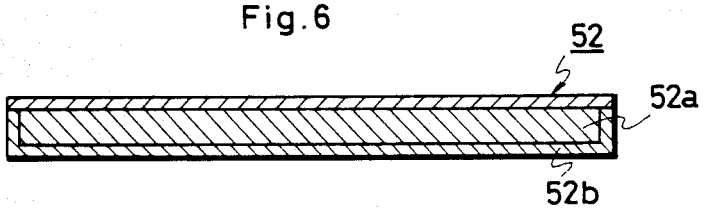
Figure 7:
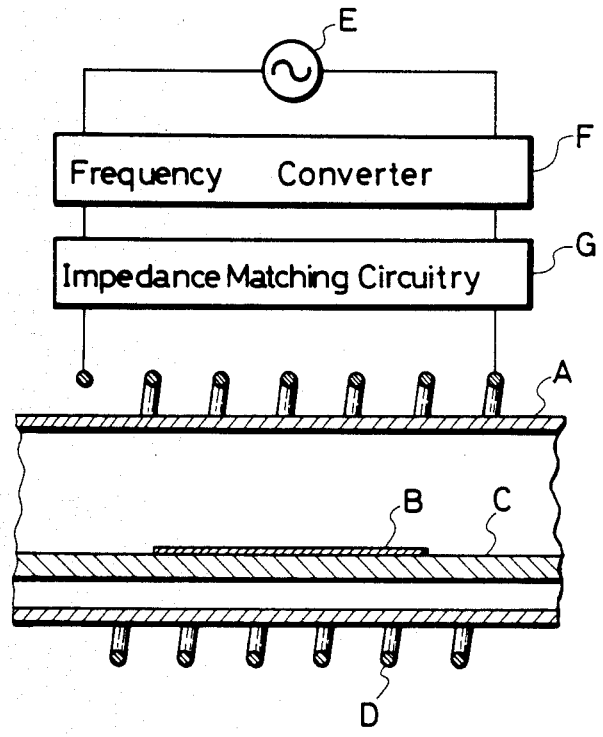
Fig. 7 Prior Art
FIG. 7 is a diagramatical side view in section showing a lateral type epitaxial growth apparatus of the conventional high-frequency induction heating system.

FIG. 5 shows another susceptor 42 which is formed in such a manner that a low-resistance ferromagnetic substance 42*a* similar to that shown in FIG. 4 is enveloped by a pair of thin stainless steel plates 42*b* and peripheral portions 42*c* of the thin plates 42*b* are tightly welded to each other.

FIG. 5 shows a further susceptor 52 which is formed in such a manner that a low-resistance ferromagnetic substance 52*a* similar to that shown in FIG. 4 is put in a vessel 52 made of an inert material such as quartz or the like. In the case where the vessel 52*b* is made of quartz, a semiconductor wafer supported on the vessel 52*b* is heated through radiation.

Each of the susceptors 2, 12, . . . according to the present invention utilizes heat generation in the low-resistance ferromagnetic substance. On the other hand, a ferromagnetic substance has a characteristic that the permeability thereof is suddenly lowered when the heating temperature reaches a Curie point.

In the induction heating according to the present invention, the quantity of heat generation in the susceptor depends on the permeability of the low-resistance ferromagnetic substance, and therefore if the quantity of heat generation at temperatures lower than the Curie point is balanced with the quantity of heat generation at temperatures not lower than the Curie point, the temperature of the susceptor becomes stabilized at the Curie point. That is, isothermal control can be performed on heat treatment, if the Curie point of the low-resistance ferromagnetic substance is selected so as to correspond to the temperature required for the heat treatment.

As described above, according to the present invention, heat can be generated by a quantity greater than that in the conventional method without increasing the amount and/or the frequency of a current passed through a magnetic field generating coil, resulting in a high efficiency in conversion of the electric power consumption into the quantity of heat generated for the heat treatment.

Further, upon generation of the alternating magnetic field by means of the coil, the impedance of the coil becomes high so that the impedance matching of the coil with a frequency converter, a high-frequency oscillator, or the like, is facilitated, and in some cases the impedance matching means may be omitted to reduce the losses in the impedance matching means so that the conversion efficiency is further improved.

Further, according to the invention, it is possible to obtain such a further meritorious effect that isothermal control can be performed onto the low-resistance ferromagnetic substance of the susceptor at the Curie point thereof.

What is claimed is:

1. A heating apparatus for use in heating a plurality of semiconductor wafers for epitaxial growth processing, comprising:

a ferromagnetic susceptor for receiving a plurality of semiconductor wafers thereon;

a first quartz pipe within which said ferromagnetic susceptor is adapted to be located, said pipe being operable to enable said wafers to be removably positioned on said susceptor;

a semiconductor treatment atmosphere maintained within said first quartz pipe for isolating said ferromagnetic susceptor and said semiconductor wafers from an external atmosphere, said ferromagnetic susceptor inert to said treatment atmosphere;

a second quartz pipe disposed within said first quartz pipe;

a rotor within said second quartz pipe, said rotor having a periphery carrying a plurality of alternating magnetic poles for generating a magnetic flux; and an electromotive source for rotating said rotor;

said susceptor encircling said second quartz pipe whereby rotation of said rotor by said electromotive means through said magnetic flux induces corresponding eddy currents in said ferromagnetic susceptor, said eddy currents generating heat in said ferromagnetic susceptor, thereby heating said semiconductor wafers disposed thereon.

2. The apparatus claim 1, wherein said ferromagnetic susceptor is made of a material selected from the group consisting of iron, nickel, cobalt and an alloy thereof.

3. The apparatus of claim 1, wherein said ferromagnetic susceptor is plated with nickel.

4. The apparatus of claim 1, wherein said ferromagnetic susceptor is substantially enveloped by stainless steel.

5. The apparatus of claim 1, wherein said ferromagnetic susceptor is shaped to receive said wafers along the outer periphery of said susceptor.

6. A method of heating a plurality of semiconductor wafers comprising the steps of:

mounting each said semiconductor wafer on a ferromagnetic susceptor;

positioning said ferromagnetic susceptor within a first quartz pipe;

maintaining a semiconductor treatment atmosphere within said first quartz pipe, said ferromagnetic susceptor inert to said treatment atmosphere;

disposing a second quartz pipe within said first quart pipe, said second quartz pipe carrying a rotor with alternating magnetic poles for generating a spatially alternating, time invariant magnetic field;

inducing eddy currents in said ferromagnetic susceptors by imparting a relative rotation between said rotor and said susceptor;

whereby heating of said susceptor by said eddy currents heats said semiconductor wafers mounted thereon.

* * * * *